US008550744B1

(12) United States Patent
Lee

(10) Patent No.: US 8,550,744 B1
(45) Date of Patent: Oct. 8, 2013

(54) PRE-FABRICATED SIDEWALK BLOCK HAVING A HEATING WIRE

(76) Inventor: Jung-Wook Lee, Incheon (KR)

( * ) Notice: Subject to any disclaimer, the term of this patent is extended or adjusted under 35 U.S.C. 154(b) by 0 days.

(21) Appl. No.: 13/992,246

(22) PCT Filed: Oct. 17, 2011

(86) PCT No.: PCT/PC2011/007688

§ 371 (c)(1),
(2), (4) Date: Jun. 7, 2013

(87) PCT Pub. No.: WO2012/077904

PCT Pub. Date: Jun. 14, 2012

(30) Foreign Application Priority Data

Dec. 10, 2010 (KR) ..... 10-2010-0126098

(51) Int. Cl.
*H05B 3/20* (2006.01)

(52) U.S. Cl.
USPC ..... 404/71; 219/213

(58) Field of Classification Search
USPC ..... 404/34, 40, 71; 52/173.1; 219/213
See application file for complete search history.

(56) References Cited

U.S. PATENT DOCUMENTS 3,236,991 A * 2/1966 Graham et al. ..... 219/213
3,904,847 A * 9/1975 Adams ..... 219/213
6,715,956 B1 * 4/2004 Weber et al. ..... 404/18
7,165,454 B2 * 1/2007 Hayashi et al. ..... 73/649
8,461,486 B2 * 6/2013 Feng et al. ..... 219/213
2009/0230113 A1 * 9/2009 Batori ..... 219/213

OTHER PUBLICATIONS

"International Search Report (Form PCT/ISA/210)", mailed on Feb. 27, 2012, with English translation thereof, p. 1-4.

* cited by examiner

*Primary Examiner* — Gary Hartmann
(74) *Attorney, Agent, or Firm* — Jianq Chyun IP Office

(57) ABSTRACT

The present invention relates to a pre-fabricated sidewalk block having a heating wire, which may effectively transmit heat through the upper portion of the sidewalk block without losing heat radiated from the heating wire to the ground; which may be easily assembled; and which may absorb the impact of walking. The pre-fabricated sidewalk having the heating wire includes: a lower block having a plurality of first groove parts in the top surface thereof; a buffer plate having a plurality of second groove parts protruding downward so that the plurality of groove parts are inserted and coupled into the first groove parts of the lower block, and which has a first heating wire insertion groove in the length direction in the top surface between the second groove parts which are adjacent to each other; an upper block having a plurality of protrusion parts protruding downward so that the bottom surface thereof is inserted and coupled to the second groove parts of the buffer plate, and which has a second heating wire insertion groove corresponding to the first heating wire insertion groove in the bottom surface between the protrusions which are adjacent to each other; and a heating wire inserted between the first heating wire insertion groove and the second heating wire insertion groove.

5 Claims, 2 Drawing Sheets

PRE-FABRICATED SIDEWALK BLOCK HAVING A HEATING WIRE

CROSS-REFERENCE TO RELATED APPLICATION

This application is a 371 application of an international PCT application serial no. PCT/KR2011/007688, filed on Oct. 17, 2011, which claims the priority benefit of Korean application no. 10-2010-0126098, filed on Dec. 10, 2010. The entirety of each of the above-mentioned patent applications is hereby incorporated by reference herein and made a part of this specification.

TECHNICAL FIELD

The present invention relates to a pre-fabricated sidewalk block, and more particularly, to a pre-fabricated sidewalk block having a heating wire, which efficiently transmits to an upper portion of a sidewalk block without losing heat radiated from the heating wire to the ground, is easily assembled, and absorbs an impact during the walking.

BACKGROUND ART

In general, sidewalk blocks are blocks in which block-shaped plates are covered on the road surface for sidewalk to prevent soil from being lost or damaged and to allow the pedestrians to comfortably go walking. Here, the blocks having the same shape are continuously installed along the sidewalk of the road.

Cement blocks manufactured by mixing sand, cement, and pigment are mainly used as the conventional sidewalk blocks. However, the cement blocks may be hard to apply an impact to the sole or ankle of the pedestrian.

In recent years, sidewalk blocks manufactured using waste plastic or waste tires have been installed to mitigate the impact applied to the pedestrians.

Since the conventional sidewalk blocks are relatively smooth, if the surfaces of the sidewall blocks are covered with snow or frozen in winter, the pedestrians may slip to cause injury.

Thus, in order to ensure the safety of pedestrians in winter, calcium chloride may be sprayed on the sidewalk blocks to perform a de-icing operation, or heating wires may be installed under the sidewalk blocks to remove the snow or frost on the sidewalk blocks.

However, in the case where the heating wires are installed under the conventional sidewalk blocks, heat generated from the heating wires may not be transferred to the upper portions of the sidewalk blocks, but be absorbed into the ground. In addition, since the heating wires are installed between the sidewalk blocks and the ground, the hating wires may be damaged.

DISCLOSURE OF THE INVENTION

Technical Problem

An object of the present invention is to provide a pre-fabricated sidewalk block having a heating wire, in which a groove part is defined in a top surface of a lower block, a groove part protruding downward to correspond to the groove of the lower block is defined in a buffer plate, a protrusion part protruding downward so that the protrusion part is inserted into the groove part of the buffer plate is disposed on an upper block, a heating wire insertion groove is defined between a top surface of the buffer plate between the groove parts of the buffer plate and a bottom surface of the upper block between the protrusion parts of the upper block to successively stack and assemble the lower block, the buffer plate, the heating wire, and the upper block.

Another object of the present invention is to provide pre-fabricated sidewalk block having a heating wire, in which a buffer plate having an insulation function is disposed between a lower block and an upper block, and the heating wire is disposed between the buffer plate and the upper block to prevent heat radiated from the heating wire from being lost into the ground.

Another objection of the present invention is to provide pre-fabricated sidewalk block having a heating wire, in which each of circumferences of groove parts of a lower block, a buffer plate, and an upper block has an inclined plane to disperse a load.

Technical Solution

According to an aspect of the present invention, there is provided a pre-fabricated sidewalk block having a heating wire, the pre-fabricated sidewalk block including: a lower block including a plurality of first groove parts in a top surface thereof; a buffer plate including a plurality of second groove parts protruding downward so that the plurality of second groove parts are inserted and coupled into the first grove parts of the lower block, the buffer plate having a first heating wire insertion groove in a length direction in a top surface thereof between the second groove parts; an upper block comprising a plurality of protrusion parts protruding downward so that a bottom surface of the upper block is inserted and coupled to the second groove parts of the buffer plate, the upper block having a second heating wire insertion groove corresponding to the first heating wire insertion groove in a bottom surface thereof between the protrusion parts adjacent to each other; and a heating wire inserted between the first heating wire insertion groove and the second heating wire insertion groove.

Each of circumferences of the first and second groove parts may have an inclined plane, and the buffer plate may be formed of a silicon or PVC material.

Ends of the first heating wire insertion grooves adjacent to each other and ends of the second heating wire insertion grooves adjacent to each other may be connected to each other through a curved insertion groove.

The upper block may have a thickness of about 150 mm to about 250 mm.

Advantageous Effects

According to the present invention, since the groove part of the buffer plate and the protrusion part of the upper block are successively inserted, stacked, and coupled into the groove part defined in the top surface of the lower block, the pre-fabricated sidewalk block may be easily assembled.

Also, the buffer plate may be disposed between the upper block and the lower block to prevent the upper and lower blocks from being damaged due to the impact therebetween and reduce the impact applied to the pedestrian.

Also, the heat radiated from the heating wire may be blocked by the buffer plate to prevent the heat from being lost into the ground through the lower block, thereby efficiently transferring the heat toward the top surface of the upper block and increasing de-icing efficiency.

Also, each of the circumferences of the groove parts of the lower block and the buffer plate may have the inclined plane to disperse the load, thereby preventing the pre-fabricated sidewalk block from being damaged due to the excessive load, and thus increasing the replacement period of the sidewalk block.

MODE FOR CARRYING OUT THE INVENTION

Example embodiments of the present invention will now be described more fully hereinafter with reference to the accompanying drawings.

Figure 1:
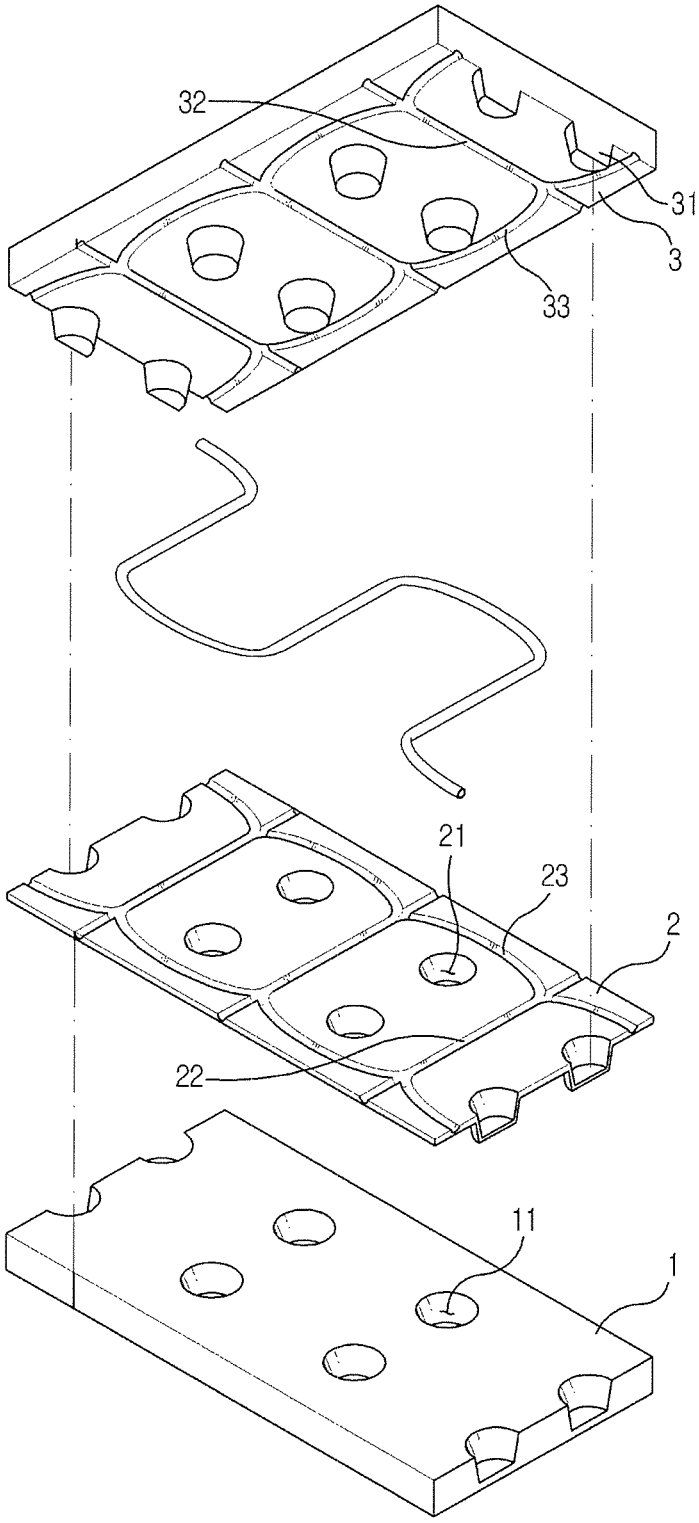
FIG. 1 is a plan view of a pre-fabricated sidewalk block including a heating wire according to the present invention.
Figure 2:
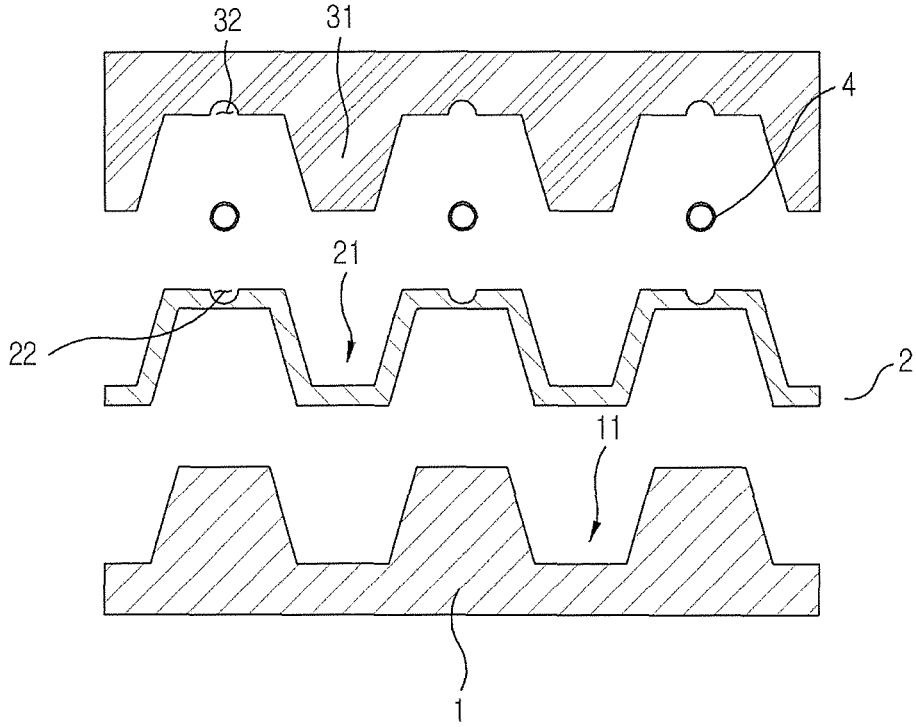
FIG. 2 is an exploded cross-sectional view of the pre-fabricated sidewalk block including the heating wire according to the present invention.

FIG. 1 is a plan view of a pre-fabricated sidewalk block including a heating wire according to the present invention, and FIG. 2 is an exploded cross-sectional view of the pre-fabricated sidewalk block including the heating wire according to the present invention.

Referring to FIGS. 1 and 2, a pre-fabricated sidewalk block including a heating wire according to the present invention includes a lower block 1, a buffer plate 2, an upper block 3, and a heating wire 4.

Here, the lower block 1 is installed on the ground. Also, a plurality of first groove parts 11 are defined in a top surface of the lower block 1. Here, each of the first groove parts 11 may have an inclined plane having a predetermined inclined angle on a circumference thereof. That is, since the circumference of the first groove part 11 has the inclined structure, when a load of a pedestrian is applied to the sidewalk block after the lower block 1 is assembled with the upper block 3 that will be described later in detail, the load may be dispersed in the inclined direction without being applied in a direction perpendicular to the ground to prevent the sidewalk block from being damaged due to the excessive load.

The buffer plate 2 may be coupled between the lower block 1 and the upper block to prevent the lower block 1 and the upper block 3 from being damaged due to collision therebetween. Also, the buffer plate 2 may mitigate an impact applied to the pedestrian and protect the heating wire 4. A plurality of second groove parts 21 in which the first groove parts 11 are inserted and coupled are defined in the buffer plate 2 to protrude downward.

Also, a plurality of first heating wire insertion grooves 22 each extending in a length direction of the buffer plate 2 and having a semicircular shape are defined in top surfaces of the buffer plate 2 between the second groove parts 21, respectively. Also, first curved insertion grooves connecting ends of the adjacent first heating wire insertion grooves 22 to each other are defined in front and rear ends of the buffer plates 2. As described above, since each of the first curved insertion grooves 23 connects the adjacent first heating wire insertion grooves 22 to each other, the heating wire may be inserted in a smoothly curved shape without being bent at the front and rear ends of the buffer plates 2.

Also, since the buffer plate 2 is formed of a silicon or PVC material, the buffer plate 2 may insulate heat radiated from the heating wire 4 to prevent the heat from being transferred to the ground through the lower block 1, thereby improving heat transfer efficiency into the upper block 3.

The upper block 3 may provide a surface layer contacting foots of the pedestrian. A plurality of protrusion parts 31 inserted and coupled into the second groove parts 21 protrude downward from a bottom surface of the upper block 3.

Also, second heating wire insertion grooves 32 each extending in a length direction of the upper block 3 and having a semicircular shape are defined in the bottom surfaces of the upper block 3 between the protrusion parts 31, respectively. Here, each of the second heating wire insertion grooves 32 may have a shape corresponding to that of each of the first heating wire insertion grooves 22. Thus, when the upper block 3 is assembled with an upper portion of the buffer plate 2, the first and second heating wire insertion grooves 22 and 32 define a circular groove so that the heating wire is inserted therein.

Also, like the buffer plate 2, second curved insertion grooves 33 connecting ends of the adjacent second heating wire insertion grooves 32 to each other may be defined in front and rear ends of the upper block 3. That is, since each of the second curved insertion grooves 33 connects the adjacent second heating wire insertion grooves 32 to each other, the heating wire may be inserted in a smoothly curved shape without being bent at the front and rear ends of the upper block 3.

The upper block 3 may have a thickness of about 150 mm to about 250 mm. That is, if the upper block 3 has a thin thickness, the heat radiated from the heating wire 4 may be well transferred to well melt snow and froze on the upper black 3. However, the heating wire may be damaged by the load or an external impact and thus be exposed to the outside. On the other hand, if the upper block 3 has a thick thickness, the heat radiated from the heating wire 4 may not be well transferred up to the top surface of the upper block 3, and thus, the snow or frost may not be well molten. Thus, the upper block 3 may have a thickness of about 150 mm to about 250 mm, particularly, a thickness of about 200 mm.

Hereinafter, a process of assembling the pre-fabricated sidewalk blocks including the heating wire according to the present invention will be described with reference to FIGS. 1 and 2.

First, the second groove part 21 defined in the bottom surface of the buffer plate 2 to protrude is inserted into the first groove part 11 defined in the top surface of the lower block 1 to stack the buffer plate 2 on the lower block 1.

Also, the heating wire is inserted into the first heating wire insertion groove 22 and the first curved insertion groove 23 which are defined in the top surface of the buffer plate 2.

Then, the protrusion part 31 protruding from the bottom surface of the upper block 3 is inserted into the second groove part 21 of the buffer plate 2 to stack and couple the upper block 3 on the buffer plate 2. Here, when the buffer plate 2 and the upper block are stacked and assembled with each other, an upper portion of the heating wire 4 inserted into the first heating wire insertion groove 22 is inserted into the second heating wire insertion groove 32.

As described above, the protrusion part having a shape corresponding to the first groove part 11 defined in the top surface of the lower block 1 and protruding from the bottom surface of the upper block 3 may be stacked on the bottom surface of the buffer plate 2. Therefore, the upper block 3, the buffer plate 2, and the lower block 1 may be easily assembled with each other.

Although the present invention is described with respect to the above-described exemplary embodiment, various modifications and variations can be made in the present invention without departing form the spirit or scope of the invention. Thus, the spirit and scope of the present invention defined by the following claims may include the modifications and variations belonging to subject matters of the present invention.

The invention claimed is:

1. A pre-fabricated sidewalk block having a heating wire, the pre-fabricated sidewalk block comprising:

a lower block comprising a plurality of first groove parts in a top surface thereof;

a buffer plate comprising a plurality of second groove parts protruding downward so that the plurality of second groove parts are inserted and coupled into the first grove parts of the lower block, the buffer plate having a first heating wire insertion groove in a length direction in a top surface thereof between the second groove parts;

an upper block comprising a plurality of protrusion parts protruding downward so that a bottom surface of the upper block is inserted and coupled to the second groove parts of the buffer plate, the upper block having a second heating wire insertion groove corresponding to the first heating wire insertion groove in a bottom surface thereof between the protrusion parts adjacent to each other; and a heating wire inserted between the first heating wire insertion groove and the second heating wire insertion groove.

2. The pre-fabricated sidewalk block of claim 1, wherein each of circumferences of the first and second groove parts has an inclined plane.

3. The pre-fabricated sidewalk block of claim 1, wherein the buffer plate is formed of a silicon or PVC material.

4. The pre-fabricated sidewalk block of claim 1, wherein ends of the first heating wire insertion grooves adjacent to each other and ends of the second heating wire insertion grooves adjacent to each other are connected to each other through a curved insertion groove.

5. The pre-fabricated sidewalk block of claim 1, wherein the upper block has a thickness of about 150 mm to about 250 mm.

* * * * *

UNITED STATES PATENT AND TRADEMARK OFFICE

CERTIFICATE OF CORRECTION

PATENT NO. : 8,550,744 B1
APPLICATION NO. : 13/992246
DATED : October 8, 2013
INVENTOR(S) : Jung-Wook Lee It is certified that error appears in the above-identified patent and that said Letters Patent is hereby corrected as shown below:

On the Title Page

Item (86) PCT NO.:

"PCT/PC2011/007688"

should be:

--PCT/KR2011/007688--.

Signed and Sealed this
Third Day of December, 2013

Margaret A. Focarino

Margaret A. Focarino
*Commissioner for Patents of the United States Patent and Trademark Office*